US007140047B2

(12) United States Patent
Kronenberger

(10) Patent No.: US 7,140,047 B2
(45) Date of Patent: Nov. 28, 2006

(54) HEADWEAR PIECE WITH MAGNETIC ACCESSORY HOLDING ASSEMBLY

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 288 days.

(21) Appl. No.: 10/639,258

(22) Filed: Aug. 12, 2003

(65) Prior Publication Data

US 2005/0034210 A1 Feb. 17, 2005

(51) Int. Cl.
*A42B 1/24* (2006.01)

(52) U.S. Cl. ..... 2/209.13

(58) Field of Classification Search ..... 2/209.13; 600/15

See application file for complete search history.

(56) References Cited

U.S. PATENT DOCUMENTS

| | | | | |
|---|---|---|---|---|
| 459,942 | A | 9/1891 | Brown | |
| 2,597,601 | A * | 5/1952 | Sherman | 43/57.1 |
| 2,693,654 | A | 11/1954 | Clark | |
| 2,769,272 | A * | 11/1956 | Goldman | 446/27 |
| 3,233,802 | A | 2/1966 | Ludwick | |
| 3,321,119 | A | 5/1967 | D'Andrea | |
| 3,546,709 | A * | 12/1970 | Cross | 43/57.1 |
| 3,622,157 | A | 11/1971 | Hatch | |
| 3,744,542 | A | 7/1973 | Stephens et al. | |
| 3,774,913 | A | 11/1973 | Dien | |
| 3,886,508 | A | 5/1975 | Lavrard | |
| 3,923,215 | A | 12/1975 | Suzuki | |
| 4,063,731 | A | 12/1977 | Kitay | |
| 4,081,114 | A | 3/1978 | Inoue | |
| 4,114,878 | A | 9/1978 | Hammond | |
| 4,130,950 | A | 12/1978 | Bazzle et al. | |
| 4,151,937 | A | 5/1979 | Jarosh et al. | |
| 4,241,917 | A | 12/1980 | Cohen | |
| 4,386,774 | A | 6/1983 | Buckman | |
| 4,489,444 | A | 12/1984 | Graham | |
| 4,530,500 | A | 7/1985 | Kaymen | |
| 4,535,987 | A | 8/1985 | Dikoff | |
| 4,627,621 | A | 12/1986 | Tate | |
| 4,885,195 | A | 12/1989 | Change, III | |
| 5,143,371 | A | 9/1992 | Strahan | |
| 5,295,683 | A | 3/1994 | Tate | |
| 5,305,999 | A | 4/1994 | Tate | |
| 5,593,073 | A | 1/1997 | Finnegan | |
| 5,604,960 | A | 2/1997 | Good | |
| 5,715,539 | A | 2/1998 | Benecki et al. | |
| 5,740,557 | A | 4/1998 | Reid | |

(Continued)

FOREIGN PATENT DOCUMENTS

| | | |
|---|---|---|
| GB | 1369506 | 10/1974 |

*Primary Examiner*—Katherine Moran
(74) *Attorney, Agent, or Firm*—Wood, Phillips, Katz, Clark & Mortimer

(57) ABSTRACT

The combination of a headwear piece, an accessory, and a plurality of discrete elements. The headwear piece has a crown defining an opening through which a wearer's head can project with the headwear piece in an operative position on the wearer's head. The crown has an inside surface with a portion for frictionally engaging a wearer's head with the headwear piece in the operative position and a first layer having an exposed outer surface. The accessory and plurality of discrete elements are magnetically attracted to each other through the first layer to releasably maintain the accessory in a stored state on the headwear piece. The plurality of discrete elements includes at least first and second discrete elements that are adjacent to each other so as to cooperatively cause a localized magnetic attractive force to be generated between the accessory and the first and second discrete elements.

37 Claims, 8 Drawing Sheets

U.S. PATENT DOCUMENTS 5,898,943 A 5/1999 Kim
5,898,946 A 5/1999 Keating et al.
5,950,239 A 9/1999 Lopez
5,996,116 A 12/1999 Tate
6,006,363 A 12/1999 Karlin
6,050,905 A 4/2000 Tate
6,153,889 A 12/2000 Tate
6,163,889 A * 12/2000 Tate ..... 2/209.13
6,170,088 B1 * 1/2001 Tate ..... 2/209.13
6,175,963 B1 1/2001 Loeffelholz
6,258,020 B1 * 7/2001 Lopez ..... 600/15
6,267,720 B1 * 7/2001 Knox et al. ..... 600/15
6,484,322 B1 * 11/2002 Christian ..... 2/209.13
6,519,779 B1 2/2003 Taguchi
6,564,391 B1 5/2003 Shwartz et al.

* cited by examiner

HEADWEAR PIECE WITH MAGNETIC ACCESSORY HOLDING ASSEMBLY

BACKGROUND OF THE INVENTION

1. Field of the Invention

This invention relates to headwear capable of releasably holding accessories through magnetic attraction between the accessories and the headwear.

2. Background Art

Those who play golf regularly use accessories such as ball markers, tees, ball mark repair tools, score keeping pencils, etc. Ideally, certain of these accessories are kept on the person of the golfer to be readily accessible at all times throughout a round of golf.

Commonly, these accessories are kept in the golfers' pockets. While this makes the accessories available, it does not always make them readily accessible. Golfers are often seen fumbling through their pockets to find a ball marker or a pencil which may be difficult to reach in a deep or tight pocket, or intermingled with other objects in a particular pocket.

Storage of accessories in a golfer's pocket has another drawback. Ball mark repair tools, pencils, and ball markers all have sharp points which may represent an irritant as the golfer maneuvers. Any of these accessories could be inadvertently pressed against the user's skin, in the region underlying the pocket, so as to cause significant pain or, in a worst case, injury through penetration of the skin.

Golfers commonly empty their pockets as they begin a round of golf so that their movements are unrestrained and so that they do not contend with the potential distraction of a foreign object in the pocket either producing noise or rubbing against the body during a swing. This has led to the incorporation of accessory holding structure on headwear. Storage of accessories on headwear has the advantage that the accessories remain at all times readily accessible, At the same time, the golfer is not in any way inconvenienced by their presence.

A number of different accessory holding structures have been developed over the years. Cloth loops have been sewn on the exterior of headwear to allow press fitting of accessories. This system may be inconvenient in that the loops generally are custom designed for but a single accessory configuration. Further, the user is often inconvenienced by the process of placing the accessory in the stored state. That is, the user may be forced to hunt for the accessory receptacle and then carefully guide the accessory in a particular orientation into the receptacle. This inconvenience often leads the golfer to remove the headwear piece each time the accessory is placed in the stored state.

It is also known to provide a discrete element on the headwear, which is magnetically attracted to the accessory. While this structure obviates the need to guide the accessory into its stored state, the user is still required to align the magnetically attractive portions on the headwear piece and accessory to place the accessory in the stored state. This operation may have an associated inconvenience sufficient that the user again finds it most efficient to remove the headwear piece to store the accessory.

Ideally, accessories would be placeable in the stored state on headwear with a minimal amount of effort and inconvenience and would be held positively in place yet be readily separable when use of the same is desired.

SUMMARY OF THE INVENTION

In one form the invention is directed to the combination of a headwear piece, an accessory, and a plurality of discrete elements. The headwear piece has a crown defining an opening through which a wearer's head can project with the headwear piece in an operative position on the wearer's head. The crown has an inside surface with a portion for frictionally engaging a wearer's head with the headwear piece in the operative position and a first layer having an exposed outer surface. The accessory and plurality of discrete elements are magnetically attracted to each other through the first layer to releasably maintain the accessory in a stored state on the headwear piece. The plurality of discrete elements includes at least first and second discrete elements that are adjacent to each other so as to cooperatively cause a localized magnetic attractive force to be generated between the accessory and the first and second discrete elements.

In one form, the first and second discrete elements are each disc-like elements having an effective diameter. The first and second discrete elements are spaced from each other a distance less than the effective diameter of one of the first and second discrete elements.

In one form, the first and second discrete elements are joined to each other by a flexible hinge which allows the first and second discrete elements to be maintained in a desired spaced relationship and selectively repositioned relative to each other.

In one form, the effective diameter of each of the first and second discrete elements is not greater than 1¼ inches.

In one form, the first and second discrete elements are respectively held in first and second pockets. The first pocket is defined between the first layer and a second layer.

The first and second layers may be connected to each other to define the first pocket.

This connection may be made by stitching or otherwise.

In one form, the discrete elements reside between the first and second layers.

In one form, the plurality of discrete elements includes at least a third discrete element. The third discrete element and accessory are magnetically attracted to each other through the first layer to releasably maintain the accessory in the stored state. The third discrete element is adjacent to the second discrete element so that the first, second, and third discrete elements extend in a substantially continuous manner in an elongate pattern.

In one form, the crown has a bottom edge extending around the opening and the second layer projects upwardly from the bottom edge and defines a sweatband.

In one form, the elongate pattern has a length extending circumferentially around the crown opening and the discrete elements are allowed to reposition relative to each other to conform to the curvature of a wearer's head.

In one form, the second layer is connected to the first layer so as to define the first pocket within which the first discrete element is confined.

The second layer may be connected to the first layer so as to define the second pocket within which the second discrete element is confined.

In one form, the second layer is connected to the first layer between the first and second pockets so that the first discrete element cannot migrate from the first pocket into the second pocket.

In one form, the crown has a circumferential extent around the opening and the plurality of discrete elements extend in a substantially continuous manner in an elongate pattern which extends through at least one quarter of the circumferential extent of the crown.

The elongate pattern may extend through greater than one half the circumferential extent of the crown and in one form extends substantially fully around the circumferential extent of the crown.

In one form, the exposed outside surface of the crown has a curved contour and the accessory has a curved surface that conforms to the curved contour of the outside surface of the crown.

In one form, the accessory is a ball mark repair tool.

In one form, the accessory includes an attachment. The attachment and the plurality of discrete elements are magnetically attracted to each other.

The invention is further directed to a combination including a headwear piece, an accessory, and at least one discrete element. The headwear piece has a crown defining an opening through which a wearer's head can project with the headwear piece in an operative position on the wearer's head. The crown has an inside surface with a portion for frictionally engaging a wearer's head with the headwear piece in the operative position, a first layer having an exposed outside surface, and a second layer. The accessory and plurality of discrete elements are magnetically attracted to each other through the first layer to releasably maintain the accessory in a stored state on the headwear piece. The first and second layers are connected to each other around a first pocket within which a first discrete element resides.

The first and second layers may be connected by stitching.

In one form, the first and second layers are connected to each other around a second pocket within which a second discrete element resides.

In one form, the first discrete element is movably confined within the first pocket.

In one form, the first discrete element is blocked from migrating from the first pocket into the second pocket.

In one form, one or both of the first and second discrete elements has a disc-like shape.

The first and second discrete elements have an effective diameter. In one form, the effective diameter is not greater than 1¼ inches.

In one form, the first and second discrete elements are spaced from each other a distance that is not greater than the effective diameter of the first discrete element.

DETAILED DESCRIPTION OF THE DRAWINGS

Figure 1:
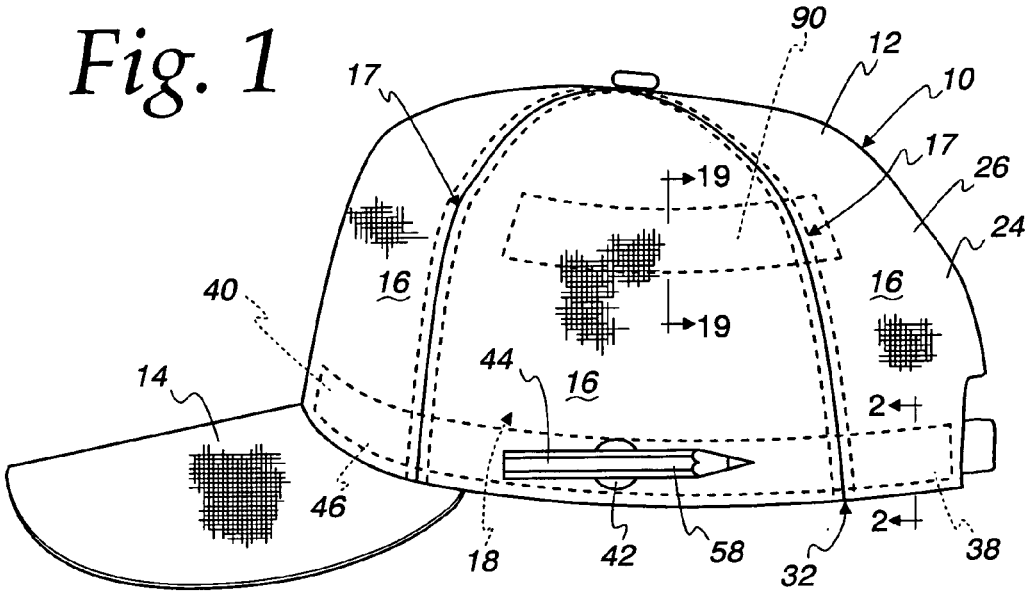
FIG. 1 is a side elevation view of one form of headwear piece having a first component thereon which is magnetically attracted to a second component on an accessory, in the form of a pencil, to maintain the pencil releasably in a stored state on the headwear piece.
Figure 2:
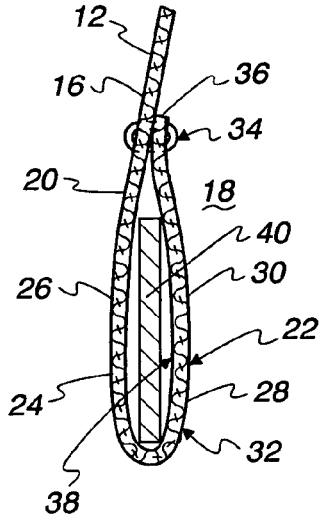
FIG. 2 is an enlarged, fragmentary, cross-sectional view of the crown and first component on the headwear piece taken along line 2—2 of FIG. 1 with the first component incorporated into a sweatband.

In FIG. 1, one form of headwear piece, with the present invention incorporated, is shown at 10. The headwear piece 10 is what is conventionally referred to as a baseball-style cap. The headwear piece 10 has an inverted, cup-shaped crown 12 with a forwardly projecting rim/visor 14. The crown 12 is defined by a plurality of gores 16 which are joined, edge to edge, with lines of stitching at 17 to produce the cup-shaped configuration. As seen additionally in FIG. 2, the fabric in each gore 16 is doubled back against itself at the inside 18 of the crown 12 at the bottom thereof. In this particular embodiment, a single sheet 20 is doubled back against itself to define a sweat band at 22. The sheet 20 in each gore 16 has a first layer 24 defining the exposed, outside surface 26 of the crown 12, and a second layer 28 on the inside 18 of the crown 12. The second layer 28 has an inside surface 30 which extends around an opening 32 on the bottom edge of the crown 12 through which a wearer's head can project with the headwear piece 10 in an operative position on the wearer's head. The inside surface 30 frictionally engages the wearer's head to maintain the headwear piece 10 in the operative position. Spot stitching, or a line of stitching 34, can be used to secure the upper edge 36 of the second layer 28 to the first layer 24.

Figure 3:
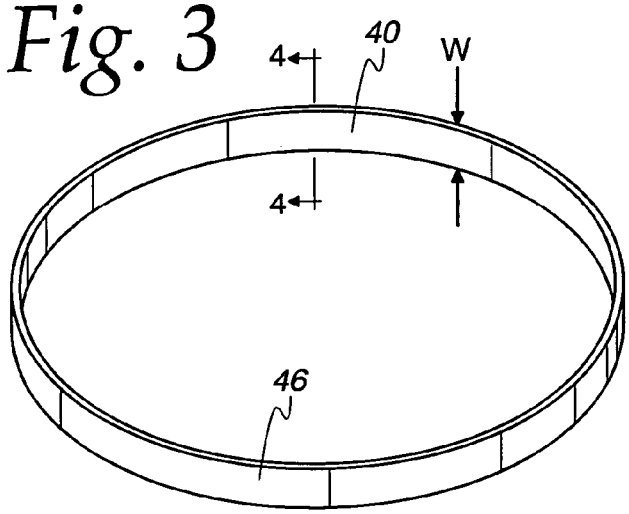
FIG. 3 is a perspective view of the first component on the headwear piece of FIGS. 1 and 2, in the form of a continuous flexible band.

With this arrangement, a receptacle 38 is defined between the first and second layers 24, 28. According to the invention, the receptacle 38 is utilized to accommodate a first component 40 in FIGS. 3 and 4, that is magnetically attracted to a second component 42, that is connected to a scoring pencil 44, of the type commonly used when playing golf. According to the invention, the pencil 44 can be releasably maintained in a stored state in any one of a plurality of different positions through the magnetic attraction between the first and second components 40, 42. In this embodiment, as in all embodiments described below, the first component 40 may be magnetized, with the second component 42 being defined at least partially by metal that is attracted to the first component 40. Alternatively, the first component 40 may be made partially or entirely from metal that is attracted to the second component 42, that is magnetized. For purposes of simplicity, throughout this description, the first component that is on the headwear piece 10 will be described as magnetized, with the cooperating second component being described as a metal that is attracted to the first component.

The first component 40 is shown as an endless band 46 which extends continuously around the opening 32 within the receptacle 38. With this arrangement, the magnetic attractive force between the first and second components 40, 42 is generated through the first layer 24. As a result, the first layer 24 may obscure the presence of the first component 40. At the same time, an ability is created to place an accessory, in this case a pencil 44, in any of a plurality of different stored positions around the band 46. The magnetic attraction between the first and second components 40, 42 can be generated anywhere around the region outside of the sweatband 22 whereat the first and second components 40, 42 can be placed in close proximity.

The magnetic band 46 may have a width W that varies over a wide range. Preferably, the width W is on the order of one inch or more, but could be as small as a quarter inch, or less, and larger than one inch.

Figure 4:
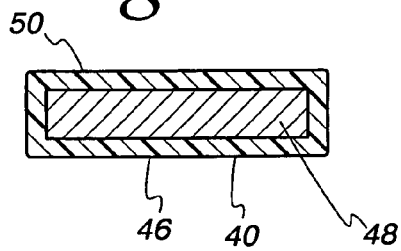
FIG. 4 is an enlarged, cross-sectional view of the band taken along line 4—4 of FIG. 3.

As shown in FIG. 4, the band 46 may be made from conventionally available material consisting of a flexible, magnetic core 48 to which a rubber coating 50 is applied.

Figure 5:
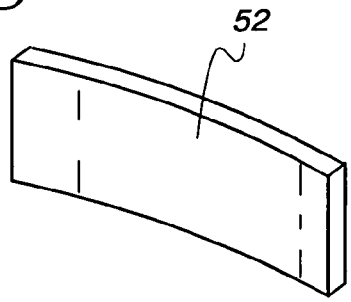
FIG. 5 is an enlarged, perspective view of a modified form of the first component in the form of an arcuate band segment.
Figure 6:
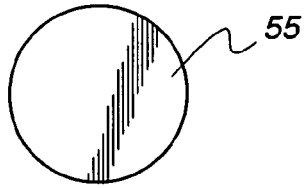
FIG. 6 is an enlarged, elevation view of a modified form of first component, having a round shape.

It is not necessary that the band 46 extend continuously, fully around the opening 32. As shown in FIG. 5, the first component may be defined by one or more arcuate segments 52. The segments 52 may be arranged end-to-end to extend to the desired degree around the opening 32.

It is not necessary that the first component have a specific shape or be pre-formed into any specific configuration. It is desirable that the first component be flexible to allow conformation to the shape of the crown 12 and the wearer's head. Alternatively, discrete magnetic elements 55, shown in FIG. 6 and FIGS. 28–37, and described in detail below, can be placed in the receptacle 38, or elsewhere, at one or more locations.

Figure 7:
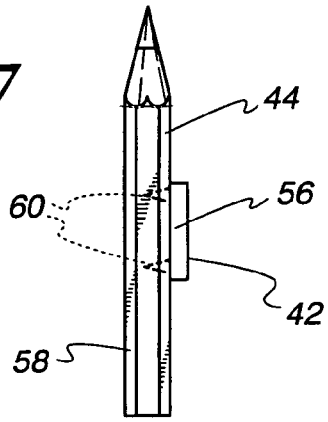
FIG. 7 is an elevation view of the pencil shown in FIG. 1, with the second component thereon and with the pencil and second component separated from the headwear piece.

The second component 42 is shown in FIGS. 1 and 7 as an attachment to the pencil 44. In this embodiment, the second component 42 is shown as a flat disc-like element 56, which can take a variety of shapes different from that shown, and which is a separate element/attachment that is secured to the body 58 of the pencil 44. In this embodiment, the second component 42 has a pair of projecting prongs 60 that can be pressed into the pencil body 58 to secure the connection between the pencil body 58 and the second component 42. The user can releasably place the pencil 44 in the stored position by placing the second component 42 into close proximity with the band 40, band segment 52, or element 55.

Figure 8:
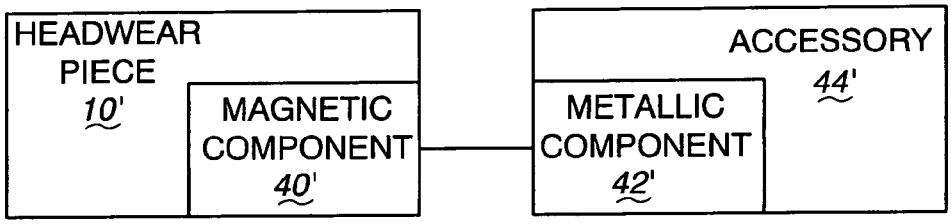
FIG. 8 is a schematic representation generically showing one form of the invention wherein the first component is magnetic and the second component is metallic.
Figure 9:
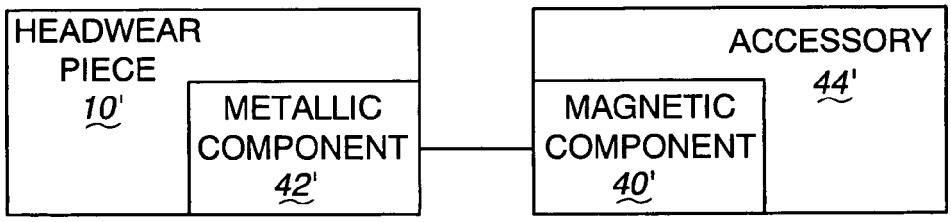
FIG. 9 is a view as in FIG. 8 wherein the first component is metallic and the second component is magnetic.

While a pencil 44 is shown as the particular accessory that is attached to the headwear piece 10, as shown in FIGS. 8 and 9, virtually any discrete accessory 44', that is relatively small in size and light in weight, can be attached using the inventive concept to virtually any type of headwear piece shown generically at 10' in these figures. The headwear piece 10' is intended to generically depict virtually any type of headwear piece, including the headwear piece 10, and others, described below, and still others not described herein. In FIG. 8, the magnetic component 40' is shown on the headwear piece 10', with the cooperating metallic component 42' shown on the accessory 44'. In FIG. 9, this arrangement is reversed, whereby the metallic component 42' is associated with the headwear piece 10', with the magnetic component 40' associated with the accessory 44'.

Figure 10:
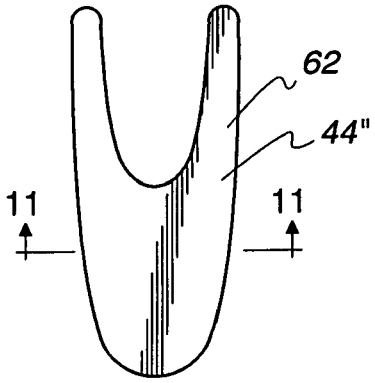
FIG. 10 is an elevation view of another form of accessory that is a ball mark repair tool that can be releasably placed in a stored state on the headwear piece of FIG. 1 utilizing the inventive concept.
Figure 11:
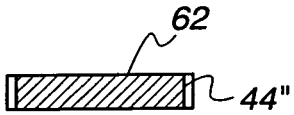
FIG. 11 is a cross-sectional view of the tool taken along line 11—11 of FIG. 10.

Other exemplary golf accessories, that can be releasably placed in a stored state, will now be described. It should be understood that the accessories are not limited to golf-related accessories. In FIGS. 10 and 11, an accessory 44" is shown in the configuration of a ball mark repair tool. The tool 44" has a conventional shape and a body 62 made from metal that will be magnetically attractive to the first component 40. Thus, the body 62 itself functions as the aforementioned second component.

Figure 12:
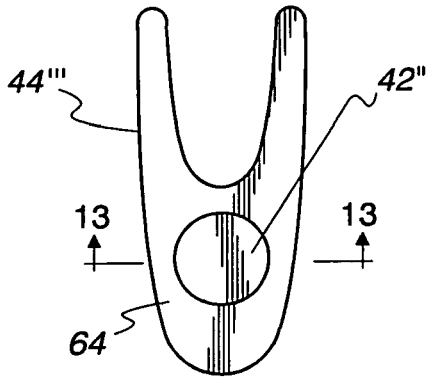
FIG. 12 is a view as in FIG. 10 wherein the second component is in the form of an attachment on the tool shown in FIG. 10.
Figure 13:
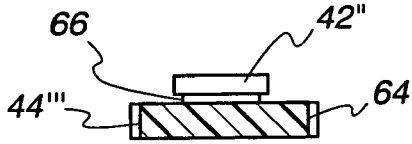
FIG. 13 is a cross-sectional view of the tool taken along line 13—13 in FIG. 12.

In FIGS. 12 and 13, a modified form of accessory 44'" is shown with a body 64 that is made from a plastic material. A metallic component 42", in a disc-shaped form, is secured, as by an adhesive layer 66, to the body 64. With the tool 44'" in a stored state, the metallic component 42" is magnetically attracted to the first component 40.

Figure 14:
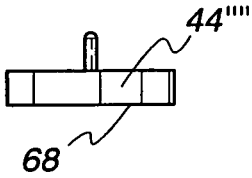
FIG. 14 is an elevation view of another form of accessory that is a ball mark that can be releasably placed in a stored state on the headwear piece in FIG. 1 utilizing the inventive concept and wherein the body of the ball mark functions as the second component.
Figure 15:
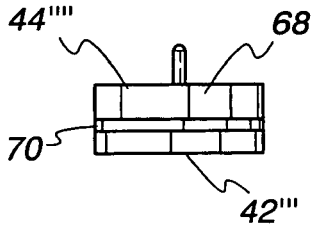
FIG. 15 is a view as in FIG. 14 wherein the second component is defined by an attachment on the body of the ball mark.

In FIGS. 14 and 15, a modified form of accessory 44"" is shown in the form of a ball mark. The ball mark 44"" in FIG. 14 has a metal body 68 which functions as the metallic component 42' and is magnetically attracted to the first component 40. In FIG. 15, the body 68 is shown with a plastic construction. A metallic component 42'" is adhered, as by an adhesive layer 70, to the body 68 and is magnetically attracted to the first component 40 to allow the ball mark 44"" to be releasably placed in the stored state on the headwear piece 10.

Figure 16:
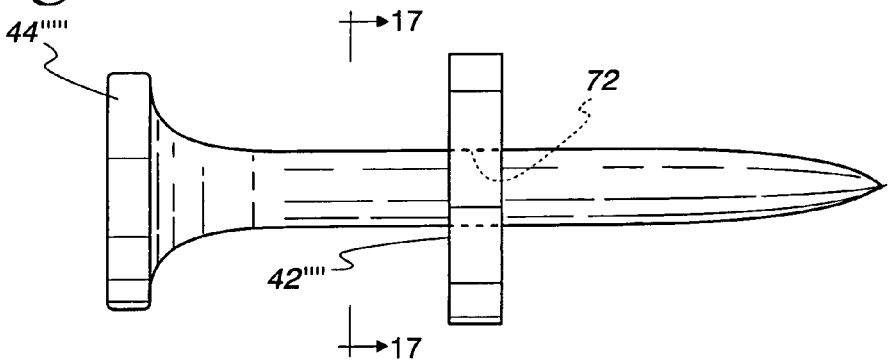
FIG. 16 is an enlarged, elevation view of still another form of accessory that is a golf tee with an attachment/second component thereon that allows the golf tee to be releasably placed in a stored state on the headwear piece of FIG. 10 utilizing the inventive concept.
Figure 17:
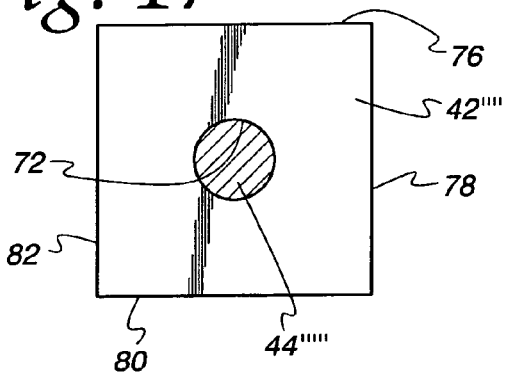
FIG. 17 is a cross-sectional view of the tee and second component taken along lines 17—17 of FIG. 16.

In FIGS. 16 and 17, another accessory 44""", in the form of a golf tee, is shown press fit into an opening 72 in a metallic component 42"". The metallic component 42"" has four edge portions 76, 78, 80, 82, which can be selectively placed against the crown 12 in the vicinity of the first component 40 to releasably maintain the tee 44""" in the stored state.

Other variations are contemplated by the invention. While some of these variations will be described, it should be understood that these are only exemplary in nature and still further modifications are contemplated by the invention.

Figure 18:
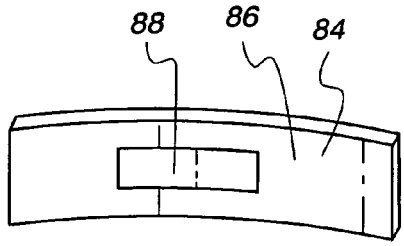
FIG. 18 is a view as in FIG. 5 wherein an insert is used on the band segment to define the first component.

As shown in FIG. 18, as an alternative to a homogeneous metallic or magnetic band 46, a band 84 may be made with a body 86 having an insert 88 functioning as the first component. The insert 88 could be, for example, a metallic or magnetic component embedded in plastic defining the body 86.

Figure 19:
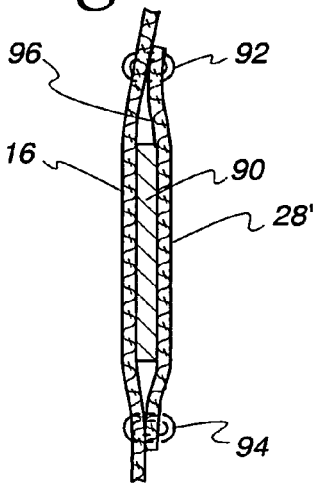
FIG. 19 is an enlarged, cross-sectional view showing a flexible element/band mounted at a different location on the headwear piece of FIG. 1 and taken along line 19—19 of FIG. 1.

As shown in FIGS. 1 and 19, a flexible element/band 90 can be mounted on the crown 12 at a location spaced from the region of the sweatband 22. In this embodiment, the layer 28', corresponding to the second layer 28, is secured by stitching at 92, 94, so as to create a receptacle 96 within which the band 90 is captively held. The band 90 may be a metallic or magnetic component, depending upon the nature of the component on, or that defines, the accessory with which it cooperates.

Figure 20:
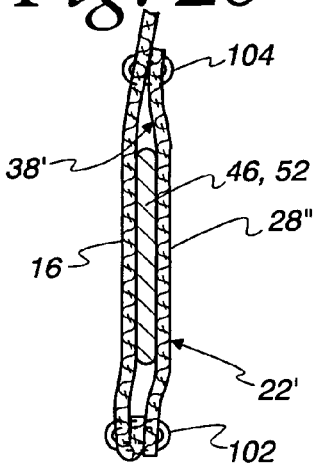
FIG. 20 is a view corresponding to that in FIG. 2 and showing a modified form of sweatband into which the flexible element/band is incorporated.
Figure 21:
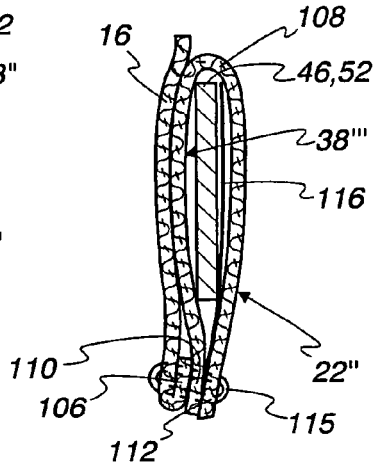
FIG. 21 is a view as in FIG. 20 showing a further modified form of sweatband into which the flexible element/band is incorporated.
Figure 22:
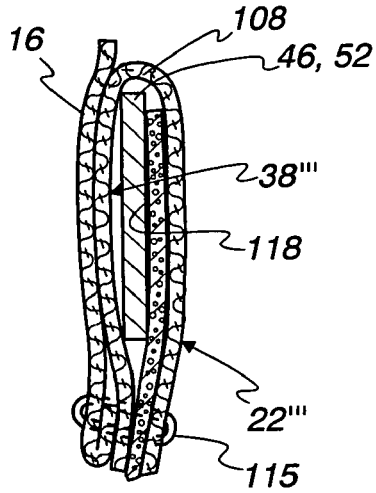
FIG. 22 is a view as in FIGS. 20 and 21 showing a still further modified form of sweatband into which the flexible element/band is incorporated.

In FIGS. 20–22, different variations of the sweatband 22 are shown. In FIG. 20, a sweatband is shown at 22' consisting of a layer 28" that is separately attached at the bottom of the gore 16 through stitching at 102, 104. The layer 28" and gore 16 cooperatively define a receptacle 38' for the endless band 46/segment 52.

In FIG. 20, a sweatband arrangement 22" is shown. In this embodiment, the gore 16 has an upturned bottom edge 106. A sheet 108 is folded against itself to define an inverted U shape with the adjacent bottom edges 110, 112 sewn to each other and the gore 16, at the doubled up bottom edge 106 thereof, by stitching 115. This arrangement produces a receptacle at 38'" for the endless band 46/segment 52. An optional additional layer 116, which may be made of fabric or other material, is disposed in the receptacle 38'" in conventional fashion.

The sweatband 22'" in FIG. 22 is similar to the sweatband 22" in FIG. 21 with the exception that a foam layer 118 is placed in the receptacle 38'" in place of the layer 116. The foam layer 118 provides cushioning between the wearer's head and the endless band 46/segment 52.

It should be understood that myriad constructions for the sweatband and endless band 46/segment 52, different than those shown, could be used consistently with the inventive concept. It is desirable only that part or all of the endless band 46/segment 52 reside at least in part against or near a layer that has an exposed surface on the exterior of the crown 12.

Figure 23:
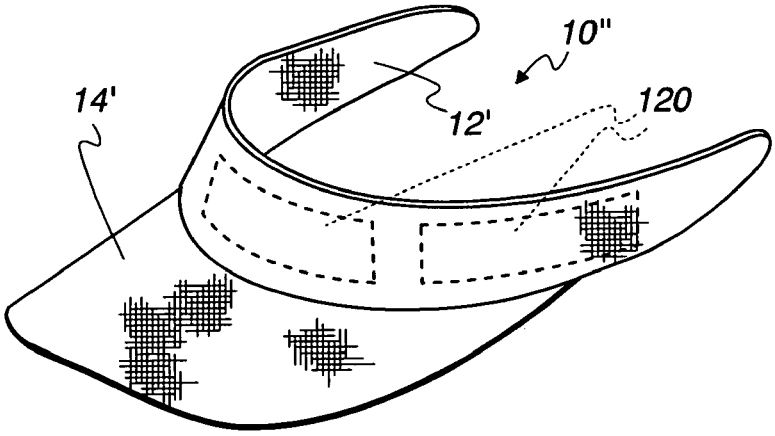
FIG. 23 is a perspective view of a visor into which the present invention is incorporated.

As previously noted, the invention can be used with virtually any type of headwear configuration. As shown in FIG. 23, a headwear piece is shown at 10" in the form of a visor with a crown 12' having a U shape to engage a wearer's head, and a forwardly projecting rim/visor 14'. One or more flexible elements/bands 120 are incorporated into the crown 12' to perform the function hereinabove explained.

Figure 24:
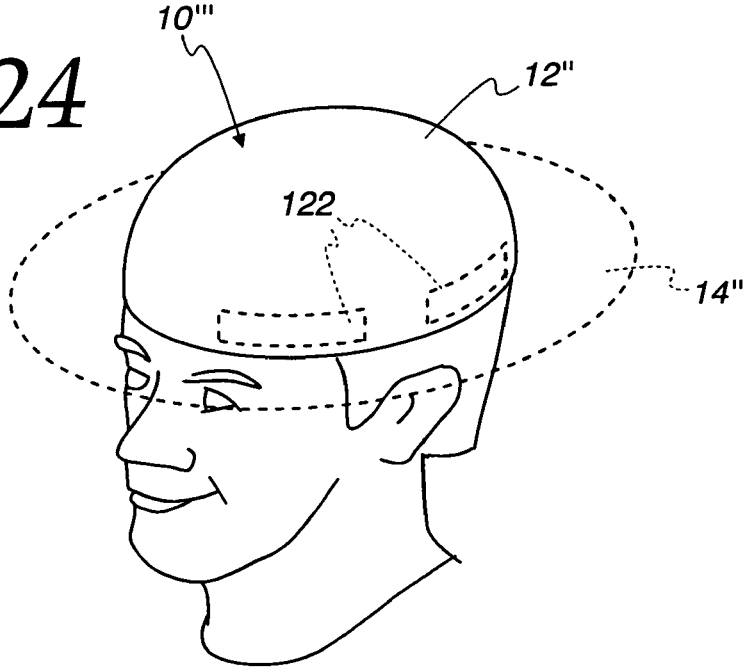
FIG. 24 is a perspective view of a further modified form of headwear piece, incorporating the present invention, and shown in an operative position on a wearer's head.

In FIG. 24, a headwear piece is shown at 10'" with a rimless crown 12" having an optional rim/visor 14" extending fully around the crown 12". One or more flexible elements/bands 122 are incorporated into the crown 12", as explained above.

Figure 25:
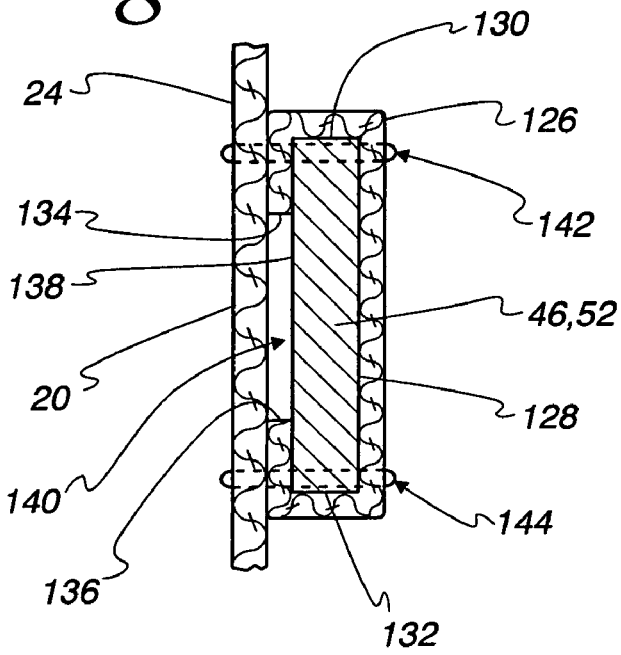
FIG. 25 is a view corresponding to that in FIG. 2 and showing an alternative structure for connecting the flexible element/band to a headwear piece.
Figure 26:
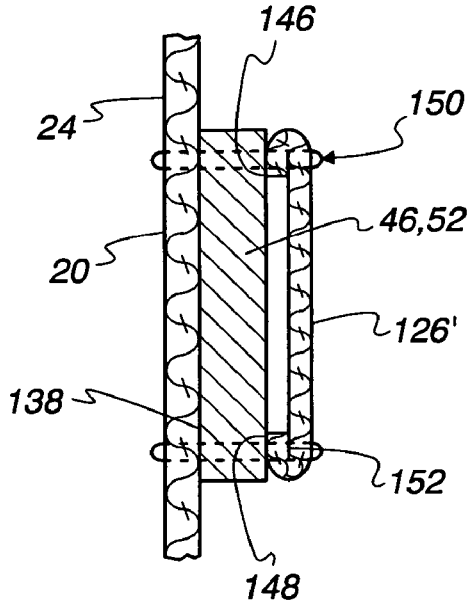
FIG. 26 is a view as in FIG. 25 showing a still further modified form of structure for connecting the flexible element/band to a headwear piece.
Figure 27:
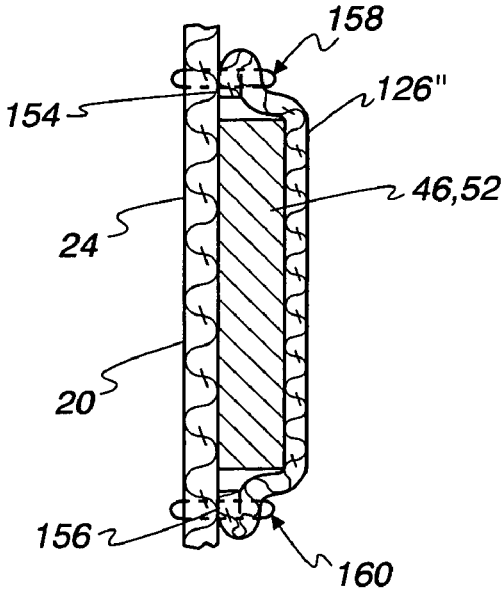
FIG. 27 is a view as in FIG. 25 of yet a further modified form of structure for connecting the flexible element/band to a headwear piece.

In FIGS. 25–27, various alternative arrangements for connecting the endless band 46/segment 52 to the headwear pieces 10, 10', 10", 10'" are shown. The band 46/segment 52 is used only for purposes of illustration as the same concept can be used to incorporate any other "first component" configuration.

In FIG. 25, a sweatband sheet layer 126 is wrapped around the band 46/segment 52. The width of the sheet layer 126 is selected so that it fully surrounds the inside surface 128, the top surface 130 and bottom surface 132 of the band 46/segment 52. The ends 134, 136 of the sheet layer 126 extend only partially over the outside surface 138 of the band 46/segment 52 so that a region at 140 of the band 46/segment 52, between the top and bottom thereof, is exposed directly to the layer 24. Separate, vertically spaced, lines of stitching at 142, 144 extend through the layer 24, two thickness of the sweatband sheet layer 126, and the band 46/segment 52.

In FIG. 26, a sweatband sheet layer 126' has ends 146, 148 doubled under so that the vertical dimension of the sweatband sheet layer 126' is approximately equal to that of the band 46/segment 52. Vertically spaced lines of stitching 150, 152 extend through the two thicknesses of the sweatband sheet layer 126', the band 46/segment 52, and the layer 24. The outside surface 138 of the band 46/segment 52 thus remains directly exposed to, and is in intimate contact with, the layer 24.

In FIG. 27, a sweatband sheet layer 126" is shown with ends 154, 156 doubled under at regions respectively above and below the band 46/segment 52. Vertically spaced lines of stitching 158, 160 extend through two thicknesses of the sweatband sheet layer 126" and the layer 24, without going through the band 46/segment 52. This produces a captive arrangement for the band 46/segment 52.

Figure 28:
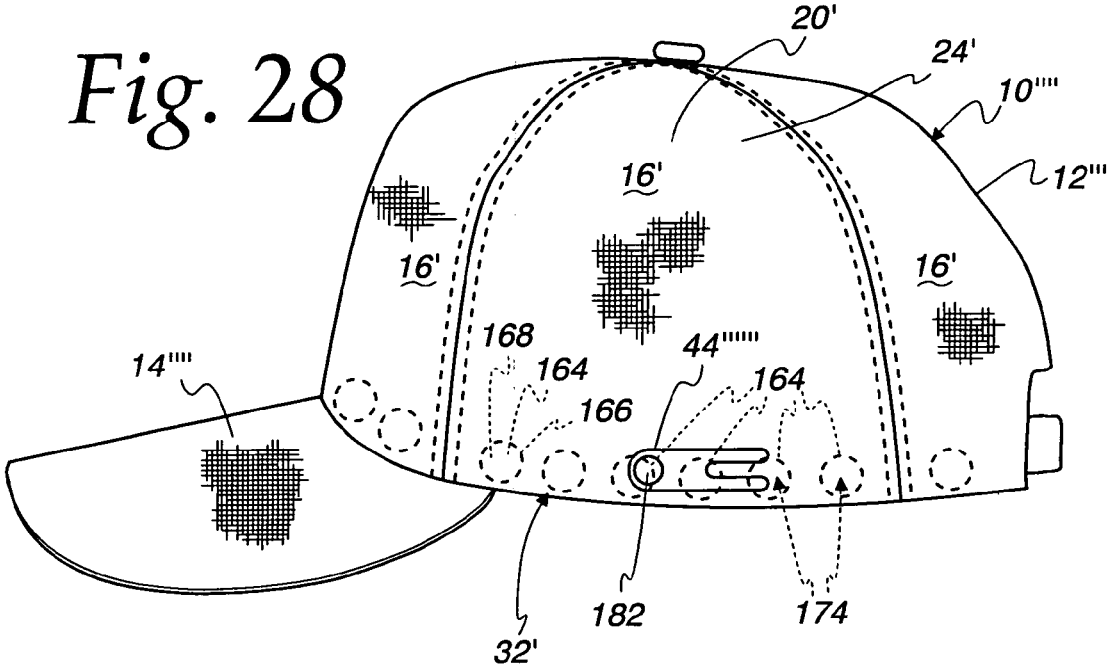
FIG. 28 is a view of a headwear piece, as in FIG. 1, and incorporating another form of the invention including a plurality of discrete elements, corresponding to the first component, with an accessory/second component maintained in a stored state thereon by a magnetic attraction force between the accessory and discrete elements.
Figure 35:
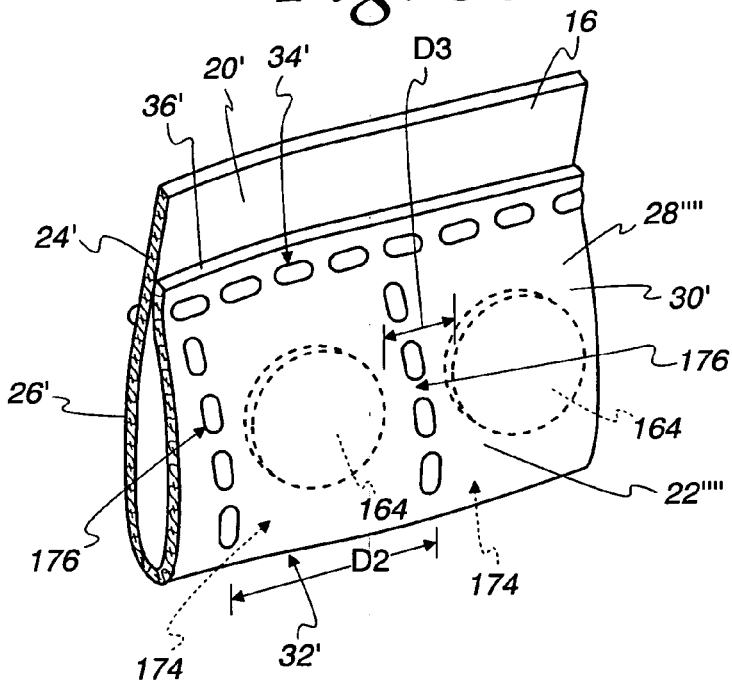
FIG. 35 is an enlarged, fragmentary, perspective view of a portion of the headwear piece in FIG. 28, in the vicinity of the discrete elements in FIGS. 29 and 30, and maintained in pockets defined thereon.

In FIGS. 28 and 35, a modified form of headwear piece, incorporating the present invention, is shown at 10"". The basic construction of the headwear piece 10"" is the same as the headwear piece 10, previously described, to include a similarly formed crown 12'" and forwardly projecting rim/visor 14"". The crown 12'" is defined by a plurality of gores 16'. A single sheet 20' defines a first layer 24' on each gore 16' and is doubled back on itself to define a second layer 28"" which defines a sweatband 22"". The layer 24' defines an exposed outside surface 26'. The sweatband 22''''/second layer 28'''' has an exposed inside surface 30' which extends around the opening 32' through which a wearer's head is projected with the headwear piece 10'''' in an operative position thereon.

Figure 29:
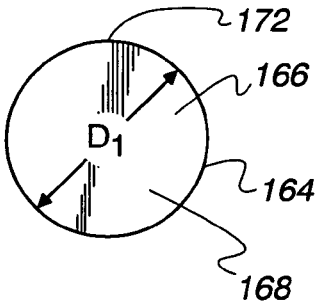
FIG. 29 is an enlarged, elevation view of one of the discrete elements shown in FIG. 28.
Figure 30:
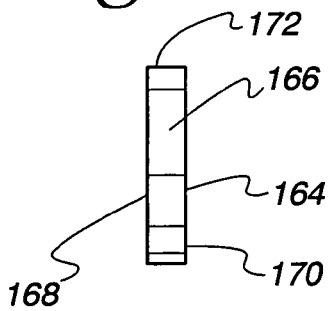
FIG. 30 is a side elevation view of the discrete element in FIG. 29.
Figure 31:
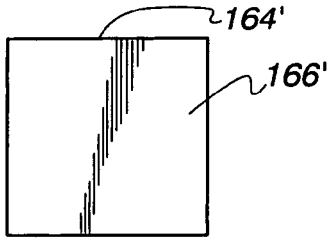
FIG. 31 is a view as in FIG. 29 of a modified form of discrete element, according to the present invention.
Figure 32:
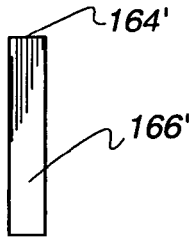
FIG. 32 is a side elevation view of the discrete element in FIG. 31.

Instead of using a band 46, or segments 52 of a band, a plurality of discrete elements 164, functioning as the aforementioned first components, are utilized, as shown additionally in FIGS. 29 and 30. The discrete elements 164 are shown as disc-like elements with a body 166 having oppositely facing flat surfaces 168, 170. While the disc-like, discrete elements 164 are shown to have a round peripheral edge 172, any of virtually a limitless number of different shapes can be used. As just one example, in FIG. 31, discrete elements 164' are shown with a square body 166' and function in the same manner as the discrete elements 164.

As seen in FIGS. 28–30 and 35, the discrete elements 164 are arranged to be received, one each, in a corresponding number of pockets 174 defined between the layers 24', 28'''' that are spaced from each other around the circumference of the crown 12'''. To define the pockets 174, the layers 24', 28'''' are strategically connected to each other, as by stitching, or otherwise. In this embodiment, spot stitching, or a line of stitching 34' is used to secure the upper edge 36' of the layer 28'''' to the layer 24'. The individual pockets 174 are defined additionally by either spot stitching, or as shown, vertically extending lines of stitching 176 which prevent migration of the discrete elements 164 from one pocket 174 to another. Adjacent lines of stitching 174 are spaced by a distance D that is slightly greater than the diameter D1 (FIG. 29) of the elements 164. Accordingly, the elements 164 are maintained at a fixed location but may be allowed to float at that location by slight shifting and rotation within their respective pockets 174. Alternatively, the stitching can be located so that the elements 164 become squeezed tightly in the pockets 174.

The elements 164 are spaced in a circumferential direction around the opening 32' at a bottom edge of the crown 12''' a distance D3 which is preferably less than the diameter D1. As a result, the discrete elements 164 align to extend in a substantially continuous manner in an elongate pattern around the circumferential extent of the crown 12''' around the opening 32'.

The elements 164 can be singly provided at any location or provided in pairs, or in a number greater than two, at any location around the headwear piece 10''''. In one form, the discrete elements 164 are arranged in an elongate pattern that extends through at least one quarter of the circumferential extent of the crown 12''''. Alternatively, the pattern may extend through one-half or greater than the circumferential extent of the crown 12''''. In the embodiment shown, the elements 164 extend continuously around the full circumferential extent of the crown 12'''' around the opening 32'.

Figure 34:
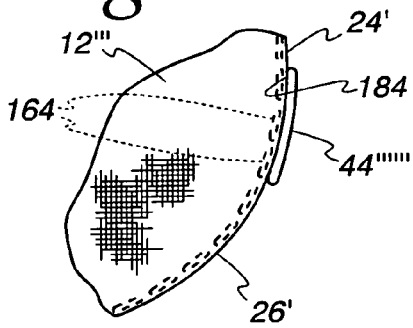
FIG. 34 is a fragmentary, plan view of the headwear piece in FIG. 1 with the ball mark repair tool shown in the stored state thereon.

As seen additionally in FIG. 34, the discrete elements 164 cooperatively produce the effect of an articulated element which is reconfigurable to conform to the head of a wearer. The pockets 174 maintain the spacing between the elements 164. However, by reason of the flexible nature of the crown 12''', the elements 164 can be repositioned relative to each other to conform to different head contours.

Figure 33:
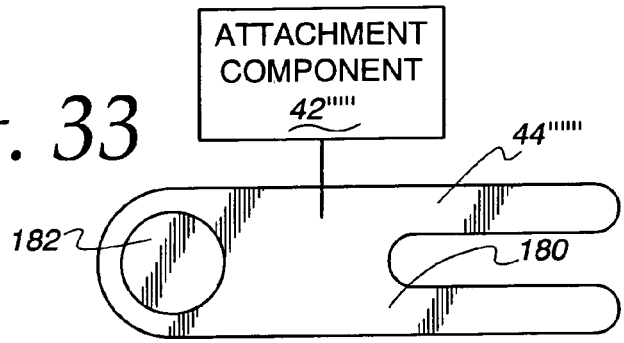
FIG. 33 is an enlarged, elevation view of a ball mark repair tool, of the type shown in stored state on the headwear piece in FIG. 28, and including a separate ball mark and having an attachment thereon functioning as the second component.

In FIGS. 28, 33 and 34, an accessory, corresponding to the aforementioned second component, is shown at 44''''' in the form of an elongate ball mark repair tool. The accessory 44''''' can be any type of accessory, as previously described, or another type, related or unrelated, to golf. The accessory 44''''' and elements 164 are magnetically attracted to each other through the layer 24', as previously described. That is, the elements 164 may be either metallic or magnetic components, with the accessory 34'''' being a complementary magnetic or metallic component. By reason of the adjacent relationship of the elements 164, they cooperatively cause a localized magnetic attractive force to be generated between the accessory 44''''' and the elements 164 at any circumferential location at which the accessory 44''''' is selectively placed in the operative state by a user. The accessory 44''''' can be reoriented so that its length extends in different directions. In the different orientations the spacing of the accessory from the inside surface of the crown remains the same. As can be seen, the accessory 44''''' can be placed directly against the exposed outside surface of the crown. Since there is no projection from the exposed outside surface of the crown in the vicinity of the elements 164, the accessory 44''''' can be freely guidingly shifted to any desired orientation without any interference. All embodiments disclosed potentially have this same capability.

Alternatively, as seen in FIG. 33, an attachment/component 42'''' may be separately integrated into the accessory 44''''', thereby allowing the body 180 of the accessory 44''''' to be made from any material, such as plastic, or the like while incorporating the ability to be magnetically attracted to the elements 164. If the body 180 is made from metal or magnetized material, this attachment/component 42'''' may be unnecessary. The accessory 44''''' is also shown to include a ball mark 182 which may be suitably, releasably maintained on the body 180.

The accessory 44''''' is shown to have a curved surface 184 which is generally complementary to the curved contour of the outside surface 26' on the crown 12'''. This allows the surface 184 to be brought into close proximity with a large surface area on one, or a number, of the elements 164. In the absence of this curvature, the magnetic attractive force may be diminished by the fact that a smaller area on the surface 184 may be placed in confronting relationship with facing surfaces on the discrete elements 164.

To produce a sufficient magnetic attractive force, the elements 164 may be made with an effective diameter D1 on the order of 1¼ inches. The term "effective diameter" is utilized in that non-circular cross-sectional arrangements for the elements 164 can be used, including the polygonal shape shown in FIGS. 31 and 32, with transverse dimensions that are approximately the same. Other shapes are also contemplated. However, magnets are currently commercially available with a substantially smaller diameter and with the ability to produce the desired and necessary magnetic attractive force. This diameter D1 potentially becomes critical only in the event that it becomes too large. Using a plurality of smaller diameter elements 164 allows a greater degree of conformity to the contours of the wearer's head.

Figure 37:
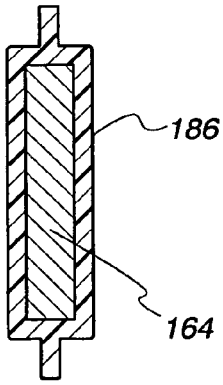
FIG. 37 is a cross-sectional view of the discrete elements and carrier taken along line 37—37 of FIG. 36.
Figure 36:
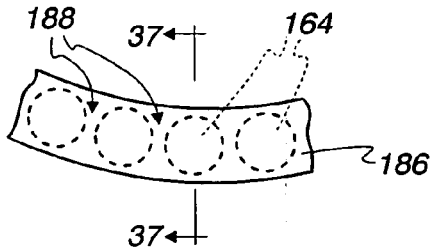
FIG. 36 is a perspective view of a plurality of discrete elements, similar in function to those shown in FIGS. 29–32, and integrated into a flexible carrier.

In another form of the invention, as shown in FIGS. 36 and 37, the elements 164 are joined through a flexible carrier/web 186. The carrier/web 186 can be made from a relatively thin material which is highly flexible. Accordingly, the carrier/web 186 functions as a flexible/live hinge 188 at each location between adjacent elements 164. The web 186 maintains the elements 164 in a generally desired spaced relationship and obviates the need to have to individually stitch or otherwise connect the layers 24', 28'''' to produce the pockets 174. The operation of the composite structure, including the carrier/web 186 and elements 164, is the same as for the elements 164 in the previously described embodiment.

The foregoing disclosure of specific embodiments is intended to be illustrative of the broad concepts comprehended by the invention.

The invention claimed is:

1. In combination:

a headwear piece having a crown defining an opening through which a wearer's head can project with the headwear piece in an operative position on a wearer's head, the crown having an inside surface with a circumference that extends around a wearer's head and a portion for frictionally engaging a wearer's head with the headwear piece in the operative position and a first layer having an exposed outside surface and permanently joined with respect to the inside surface;

an accessory; and a plurality of discrete elements that are spaced from each other in a circumferential direction around the crown, the accessory and plurality of discrete elements magnetically attracted to each other through the first layer to releasably maintain the accessory in a stored state on the headwear piece directly against the exposed outside surface selectively in each of a plurality of different orientations relative to the headwear piece, the plurality of discrete elements comprising first and second discrete elements that are adjacent to each other so as to cooperatively cause a localized magnetic attractive force to be generated between the accessory and both the first and second discrete elements with the accessory in each of the plurality of different orientations, there being no structure projecting from the exposed outside surface of the crown in the vicinity of the plurality of discrete elements that interferes with guided reorientation of the accessory against and relative to the exposed outside surface of the crown.

2. The combination according to claim 1 further comprising a third discrete element, the third discrete element and accessory magnetically attracted to each other, wherein the first, second, and third discrete elements each comprises a disc-like element having an effective diameter, and each of the first, second, and third discrete elements is spaced from another of the discrete elements a distance less than the effective diameter of one of the first, second, and third discrete elements.

3. The combination according to claim 1 wherein the first and second discrete elements each have an effective diameter that is not greater than 1¼ inches.

4. The combination according to claim 1 wherein the first and second discrete elements are respectively held in first and second pockets and the first pocket is defined between the first layer and a second layer.

5. The combination according to claim 4 wherein the first and second layers are connected to each other to define the first pocket.

6. The combination according to claim 5 wherein the first and second layers are connected to each other by stitching.

7. The combination according to claim 1 wherein the portion of the inside surface is defined by a second layer and the plurality of discrete elements resides between the first and second layers.

8. The combination according to claim 1 wherein the plurality of discrete elements comprises at least a third discrete element, the third discrete element and accessory magnetically attracted to each other through the first layer to releasably maintain the accessory in the stored state, and the third discrete element is adjacent to the second discrete element so that the first, second and third discrete elements extend in a substantially continuous manner in an elongate pattern on the headwear piece.

9. The combination according to claim 8 wherein the elongate pattern has a length extending circumferentially around the crown opening and the discrete elements are allowed to reposition relative to each other to conform to the curvature of a wearer's head.

10. The combination according to claim 1 wherein the exposed outside surface of the crown has a curved contour and the accessory has a curved surface that conforms to the curved contour of the outside surface of the crown.

11. The combination according to claim 10 wherein the accessory comprises a golf ball mark repair tool.

12. The combination according to claim 1 wherein the accessory comprises an attachment, and the attachment and plurality of discrete elements are magnetically attracted to each other.

13. The combination according to claim 1 wherein the accessory is located directly against the exposed outside surface of the first layer.

14. The combination according to claim 1 wherein the accessory has an elongate shape with a length and the length extends in different directions in first and second of the plurality of different orientations.

15. The combination according to claim 1 wherein the discrete elements are not visible at the crown.

16. The combination according to claim 1 wherein the accessory and plurality of discrete elements cooperate to releasably maintain the accessory in a stored state selectively in different locations relative to the headwear piece.

17. The combination according to claim 1 wherein each of the discrete elements has transverse dimensions that are approximately equal.

18. The combination according to claim 1 wherein the accessory is spaced from the inside surface the same distance with the accessory in each of the plurality of different orientations.

19. In combination:

a headwear piece having a crown defining an opening through which a wearer's head can project with the headwear piece in an operative position on a wearer's head, the crown having an inside surface with a circumference that extends around a wearer's head and a portion for frictionally engaging a wearer's head with the headwear piece in the operative position and a first layer having an exposed outside surface and permanently joined with respect to the inside surface;

an accessory; and a plurality of discrete elements that are spaced from each other in a circumferential direction around the crown, the accessory and plurality of discrete elements magnetically attracted to each other through the first layer to releasably maintain the accessory in a stored state on the headwear piece directly against the exposed outside surface selectively in each of a plurality of different orientations relative to the headwear piece, the plurality of discrete elements comprising first and second discrete elements that are adjacent to each other so as to cooperatively cause a localized magnetic attractive force to be generated between the accessory and both the first and second discrete elements with the accessory in each of the plurality of different orientations, wherein the first and second discrete elements are joined to each other by a flexible hinge which allows the first and second discrete elements to be maintained in a desired spaced relationship and repositioned relative to each other, the crown comprising a second layer, the first and second layers are stitched to each other at a first location and the flexible hinge is defined at the first location.

20. In combination:

a headwear piece having a crown defining an opening through which a wearer's head can project with the headwear piece in an operative position on a wearer's head, the crown having an inside surface with a portion for frictionally engaging a wearer's head with the headwear piece in the operative position and a first layer having an exposed outside surface and permanently joined with respect to the inside surface;

an accessory; and a plurality of discrete elements, the accessory and plurality of discrete elements magnetically attracted to each other through the first layer to releasably maintain the accessory in a stored state on the headwear piece selectively in a plurality of different orientations relative to the headwear piece, the plurality of discrete elements comprising first and second discrete elements that are adjacent to each other so as to cooperatively cause a localized magnetic attractive force to be generated between the accessory and the first and second discrete elements, wherein the portion of the inside surface is defined by a second layer and the plurality of discrete elements resides between the first and second layers, wherein the crown has a bottom edge extending around the opening and the second layer projects upwardly from the bottom edge and defines a sweatband.

21. The combination according to claim 20 wherein the second layer is connected to the first layer so as to define a first pocket within which the first discrete element is confined.

22. The combination according to claim 21 wherein the second layer is connected to the first layer so as to define a second pocket within which the second discrete element is confined.

23. The combination according to claim 22 wherein the second layer is connected to the first layer by stitching between the first and second pockets so that the first discrete element cannot migrate from the first pocket into the second pocket.

24. In combination:

a headwear piece having a crown defining an opening through which a wearer's head can project with the headwear piece in an operative position on a wearer's head, the crown having an inside surface with a circumference that extends around a wearer's head and a portion for frictionally engaging a wearer's head with the headwear piece in the operative position and a first layer having an exposed outside surface and permanently joined with respect to the inside surface;

an accessory; and a plurality of discrete elements that are spaced from each other in a circumferential direction around the crown, the accessory and plurality of discrete elements magnetically attracted to each other through the first layer to releasably maintain the accessory in a stored state on the headwear piece directly against the exposed outside surface selectively in each of a plurality of different orientations relative to the headwear piece, the plurality of discrete elements comprising first and second discrete elements that are adjacent to each other so as to cooperatively cause a localized magnetic attractive force to be generated between the accessory and both the first and second discrete elements with the accessory in each of the plurality of different orientations, wherein the first and second discrete elements are joined to each other by a flexible hinge which allows the first and second discrete elements to be maintained in a desired spaced relationship and repositioned relative to each other, the crown comprising a second layer, the first and second layers are stitched to each other at a first location and the flexible hinge is defined at the first location, wherein the crown has a circumferential extent around the opening, the plurality of discrete elements extend in a substantially continuous manner in an elongate pattern, and the elongate pattern extends through at least ¼ of the circumferential extent of the crown.

25. The combination according to claim 24 wherein the elongate pattern extends through greater than ½ of the circumferential extent of the crown.

26. The combination according to claim 24 wherein the elongate pattern extends substantially fully around the circumferential extent of the crown.

27. In combination:

a headwear piece having a crown defining an opening through which a wearer's head can project with the headwear piece in an operative position on a wearer's head, the crown having an inside surface with a portion for frictionally engaging a wearer's head with the headwear piece in the operative position, a first layer having an exposed outside surface and a second layer permanently joined with respect to the inside surface;

an accessory; and a plurality of discrete elements, the accessory and plurality of discrete elements magnetically to each other through the first layer to releasably maintain the accessory in a stored state on the headwear piece, the first and second layers connected to each other around a first pocket within which a first discrete element resides and is slidingly moveable.

28. The combination according to claim 27 wherein the first and second layers are connected by stitching.

29. The combination according to claim 27 wherein the first and second layers are connected to each other around a second pocket within which a second discrete element resides.

30. The combination according to claim 27 wherein the first discrete element is floatingly movable within the first pocket.

31. In combination:

a headwear piece having a crown defining an opening through which a wearer's head can project with the headwear piece in an operative position on a wearer' head, the crown having an inside surface with a portion for frictionally engaging a wearer's head with the headwear piece in the operative position, a first layer having an exposed outside surface and a second layer permanently joined with respect to the inside surface;

an accessory; and a plurality of discrete elements, the accessory and plurality of discrete elements magnetically attracted to each other through the first layer to releasably maintain the accessory in a stored state on the headwear piece, the first and second layers connected to each other around a first pocket within which a first discrete element resides and is slidingly movable, wherein the first and second layers are connected to each other around a second pocket within which second discrete element resides, wherein the first discrete element is movably confined within the pocket and is blocked from migrating from the first pocket into the second pocket by stitching between the first and second pockets.

32. The combination according to claim 31 wherein the first discrete element has a disc-like shape.

33. The combination according to claim 32 wherein the second discrete element gas a disc-like shape.

34. The combination according to claim 33 wherein the first and second discrete elements have an effective diameter that is not greater than 1¼ inches.

35. The combination according to claim 33 wherein the first and second discrete elements have an effective diameter and are spaced from each other a distance that is not greater than the effective diameter of the first discrete element.

36. In combination:

a headwear piece having a crown defining an opening through which a wearer's head can project with the headwear piece in an operative position on a wearer's head, the crown having a circumference extending around a wearer's head and an inside surface with a portion for frictionally a wearer's head with the headwear piece in the operative position, a first layer having an exposed outside surface and a second layer sewn to the first layer;

an accessory; and a plurality of discrete elements on the crown that are spaced in a circumferential direction from each other, the accessory and plurality of discrete elements magnetically attracted to each other through the first layer to releasably maintain the accessory in a stored state on the headwear piece selectively in a plurality of different orientations relative to the headwear piece, the first and second layers connected to each other around a first pocket within which a first discrete element resides, the accessory and a plurality of discrete elements magnetically attracted to each other with the accessory in the stored state in each of the plurality of different orientations, there being no structure projecting from the exposed outside surface of the crown in the vicinity of the plurality of discrete elements that interferes with guided reorientation of the accessory against and relative to the exposed outside surface of the crown.

37. The combination according to claim 36 wherein the accessory is located directly against the exposed outside surface of the first layer.

* * * * *